US011859613B2

(12) United States Patent
Han et al.

(10) Patent No.: US 11,859,613 B2
(45) Date of Patent: Jan. 2, 2024

(54) SCROLL COMPRESSOR

(71) Applicant: EMERSON CLIMATE TECHNOLOGIES (SUZHOU) CO., LTD., Suzhou (CN)

(72) Inventors: Yanchun Han, Suzhou (CN); Ji Liang, Suzhou (CN); Yue Zhang, Suzhou (CN); Xiaoyan Wang, Suzhou (CN); Litao Liu, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 206 days.

(21) Appl. No.: 17/614,472

(22) PCT Filed: Nov. 29, 2019

(86) PCT No.: PCT/CN2019/121967
§ 371 (c)(1),
(2) Date: Nov. 26, 2021

(87) PCT Pub. No.: WO2020/238110
PCT Pub. Date: Dec. 3, 2020

(65) Prior Publication Data

US 2022/0235769 A1 Jul. 28, 2022

(30) Foreign Application Priority Data

May 30, 2019 (CN) ..... 201910465901.0
May 30, 2019 (CN) ..... 201920805084.4

(51) Int. Cl.
*F04C 18/02* (2006.01)

(52) U.S. Cl.
CPC ..... *F04C 18/0215* (2013.01); *F04C 2240/30* (2013.01); *F04C 2240/50* (2013.01)

(58) Field of Classification Search
CPC ..... F04C 18/0215; F04C 2240/10; F04C 2240/30; F04C 2240/50; F04C 2240/805; F04C 23/008; F04C 27/005
See application file for complete search history.

(56) References Cited

U.S. PATENT DOCUMENTS 6,345,966 B1 * 2/2002 Hahn ..... F04C 23/008 418/181
7,322,807 B2 * 1/2008 Clendenin ..... F01C 21/003 418/57

(Continued)

FOREIGN PATENT DOCUMENTS

CN 1715659 A 1/2006
CN 101372962 A 2/2009

(Continued)

OTHER PUBLICATIONS

International Search Report dated Feb. 27, 2020, in corresponding International Application No. PCT/CN2019/121967.

*Primary Examiner* — Anthony Ayala Delgado
(74) *Attorney, Agent, or Firm* — Harness, Dickey & Pierce, P.L.C.

(57) ABSTRACT

A scroll compressor includes a fixed scroll, a movable scroll, a main bearing housing and an axial compliance mounting mechanism. The fixed scroll is engaged with the movable scroll to compress a working fluid. The main bearing housing has a bearing surface for supporting a movable scroll end plate. The fixed scroll is fixedly connected to a connecting portion of the main bearing housing by the axial compliance mounting mechanism so that the fixed scroll can move in the axial direction by a predetermined distance. The fixed scroll further includes a flange extending radially outward from a circumferential wall portion, having an axial geometric center position between a first surface and a second surface and positioned such that the axial geometric center position (Continued)

is closer to the movable scroll end plate than the axial middle position thereof. The structure can prevent or reduce damage to the axial compliance mounting mechanism.

19 Claims, 8 Drawing Sheets

(56) References Cited

U.S. PATENT DOCUMENTS

| | | | | |
|---|---|---|---|---|
| 9,689,391 | B2 * | 6/2017 | Fu | F04C 29/063 |
| 11,692,546 | B2 * | 7/2023 | Oh | F04C 29/068<br>418/55.1 |
| 2005/0201883 | A1 * | 9/2005 | Clendenin | F01C 21/003<br>418/55.5 |
| 2007/0059192 | A1 * | 3/2007 | Stover | F04C 18/0215<br>418/55.1 |
| 2017/0350396 | A1 * | 12/2017 | Su | F04C 29/06 |

FOREIGN PATENT DOCUMENTS

| | | | |
|---|---|---|---|
| CN | 201339575 | Y | 11/2009 |
| CN | 102330679 | A | 1/2012 |
| CN | 102953991 | A | 3/2013 |
| CN | 103122855 | A | 5/2013 |
| CN | 202926624 | U | 5/2013 |
| CN | 203463290 | U | 3/2014 |
| JP | 2003065255 | A | 3/2003 |

* cited by examiner

SCROLL COMPRESSOR

This application is the national phase of International Application No. PCT/CN2019/121967, titled "SCROLL COMPRESSOR", filed on Nov. 29, 2019, which claims the priorities to the Chinese patent applications Nos. 201910465901.0 and 201920805084.4 filed with the China National Intellectual Property Administration on the same day of May 30, 2019 and titled "SCROLL COMPRESSOR" These applications are incorporated herein by reference.

FIELD

The present application relates to a scroll compressor, and more specifically, to a scroll compressor capable of preventing an axial compliance mounting mechanism from failing.

BACKGROUND

This section only provide background information related to this disclosure, which may not be necessarily the prior art.

A scroll compressor may be applied in, for example, a refrigeration system, an air conditioning system, and a heat pump system. The scroll compressor includes a compression mechanism for compressing a working fluid (e.g., a refrigerant), a main bearing housing for supporting the compression mechanism, a rotating shaft for driving the compression mechanism, and a motor for driving the rotating shaft to rotate. The compression mechanism includes a non-orbiting scroll and an orbiting scroll that orbits relative to the non-orbiting scroll. The non-orbiting scroll and the orbiting scroll each include an end plate and a spiral vane extending from one side of the end plate. When the orbiting scroll orbits relative to the non-orbiting scroll, a series of moving compression chambers with volume gradually decreasing from a radial outer side to a radial inner side are formed between the spiral vane of the non-orbiting scroll and the spiral vane of the orbiting scroll, so that the working fluid is compressed.

During the normal operation of the scroll compressor, a good seal needs to be achieved between a tip end of the spiral vane of one of the non-orbiting scroll and the orbiting scroll and an end plate of the other of the non-orbiting scroll and the orbiting scroll. On the other hand, for example, in a case of excessive pressure in the compression chamber of the scroll compressor, the spiral vane can be separated from the end plate to unload the high-pressure fluid, thereby avoiding damage to the compression mechanism.

In view of this, the non-orbiting scroll is mounted to the main bearing housing via an axial compliance mounting mechanism, such that the non-orbiting scroll can axially move a certain distance relative to the orbiting scroll. The axial compliance mounting mechanism generally includes bolts and sleeves located outside the bolts. Bolts are inserted into mounting holes of the non-orbiting scroll to screw the non-orbiting scroll to the main bearing housing. Sleeves are also inserted into the mounting holes of the non-orbiting scroll and are provided between heads of the bolts and the main bearing housing, such that a certain gap is formed between the heads of the bolts and the non-orbiting scroll to enable axial movement of the non-orbiting scroll.

SUMMARY

The inventor of the present application found that the bolts of the axial compliance mounting mechanism are liable to be loose or fractured. To this end, reasons for the fatigue damage of the bolts have been deeply studied, and a solution that can improve the fatigue strength of the bolts has been proposed.

An object of the present application is to provide a scroll compressor that can prevent or reduce damage to the axial compliance mounting mechanism.

According to an aspect of the present application, a scroll compressor is provided. The scroll compressor includes a non-orbiting scroll, an orbiting scroll, a main bearing housing and an axial compliance mounting mechanism. The non-orbiting scroll has a non-orbiting scroll end plate and a non-orbiting scroll vane extending from one side of the non-orbiting scroll end plate. The orbiting scroll has an orbiting scroll end plate and an orbiting scroll vane extending from one side of the orbiting scroll end plate. The orbiting scroll is configured to orbit relative to the non-orbiting scroll, so that a series of compression chambers for compressing working fluid are formed between the non-orbiting scroll vane and the orbiting scroll vane. The main bearing housing is fixedly mounted to a housing of the scroll compressor, and has a bearing surface for slidably supporting the orbiting scroll end plate. The axial compliance mounting mechanism is configured to fixedly connect the non-orbiting scroll to a connecting portion of the main bearing housing, such that the non-orbiting scroll is movable by a predetermined distance in an axial direction. The non-orbiting scroll further has a flange extending radially outward from a peripheral wall portion of the non-orbiting scroll. The flange has a first surface facing the non-orbiting scroll end plate, a second surface facing the orbiting scroll end plate, and a mounting hole extending from the first surface to the second surface for receiving the axial compliance mounting mechanism. The flange has an axial geometric center position between the first surface and the second surface, and the flange is positioned such that the axial geometric center position is located to be closer to the orbiting scroll end plate than an axial middle position of the peripheral wall portion. A height of the flange between the first surface and the second surface is H1; a distance between an axial position of an equivalent acting point of force borne by the axial compliance mounting mechanism and the second surface is h1; a distance between the first surface and an end surface of the connecting portion is H2, a distance between the second surface and the end surface is h2; and a distance between the axial position of the equivalent acting point and the end surface is h, and h=h1+h2. The scroll compressor is such configured that the axial position of the equivalent acting point of the force applied to the axial compliance mounting mechanism is offset from the axial geometric center position toward the main bearing housing during normal operation.

In the scroll compressor according to the present application, the axial position of the equivalent acting point of the force applied to the axial compliance mounting mechanism is offset toward the main bearing housing relative to the axial geometric center position, so that the distance h can be reduced, that is, a distance D of the arm of force from the axial position of the equivalent acting point to a fracture position P can be reduced, and therefore bolt fracture can be significantly alleviated or prevented.

In some examples, an outer contour of the axial compliance mounting mechanism and/or an inner contour of the mounting hole of the flange have convex sections, such that the axial position of the equivalent acting point is offset from the axial geometric center position toward the main bearing housing.

In some examples, the convex sections are in the form of a curved surface or a shoulder forming a step.

In some examples, the flange includes an extension portion extending from the second surface in the axial direction toward the main bearing housing and beyond a top surface of the non-orbiting scroll vane.

In some examples, the connecting portion of the main bearing housing that engages with the axial compliance mounting mechanism extends in the axial direction toward the flange and beyond the bearing surface.

In some examples, the axial compliance mounting mechanism includes a bolt and a sleeve located outside the bolt. Or, the axial compliance mounting mechanism includes a shouldered bolt.

In some examples, $0<h2/H1<0.3$; $0<h2/H2<0.3$; $0<h/H1<0.6$; or $0<h/H2<0.6$.

According to the present application, a scroll compressor is further provided. The scroll compressor includes a non-orbiting scroll, an orbiting scroll, a main bearing housing and an axial compliance mounting mechanism. The non-orbiting scroll has a non-orbiting scroll end plate and a non-orbiting scroll vane extending from one side of the non-orbiting scroll end plate. The orbiting scroll has an orbiting scroll end plate and an orbiting scroll vane extending from one side of the orbiting scroll end plate. The orbiting scroll is configured to orbit relative to the non-orbiting scroll, so that a series of compression chambers for compressing working fluid are formed between the non-orbiting scroll vane and the orbiting scroll vane. The main bearing housing has a bearing surface for slidably supporting the orbiting scroll end plate. The axial compliance mounting mechanism is configured to fixedly connect the non-orbiting scroll to a connecting portion of the main bearing housing, such that the non-orbiting scroll is capable of moving a predetermined distance in an axial direction. The non-orbiting scroll further has a flange extending radially outward from a peripheral wall portion of the non-orbiting scroll. The flange has a first surface facing the non-orbiting scroll end plate, a second surface facing the orbiting scroll end plate, and a mounting hole extending from the first surface to the second surface for receiving the axial compliance mounting mechanism. A height of the flange between the first surface and the second surface is H1; a distance between an axial position of an equivalent acting point of force borne by the axial compliance mounting mechanism and the second surface is h1; a distance between the first surface and an end surface of the connecting portion is H2; a distance between the second surface and the end surface is h2; and a distance between the axial position of the equivalent acting point and the end surface is h, and $h=h1+h2$. The flange and/or the connecting portion extend toward each other in the axial direction, such that the second surface of the flange extends beyond the top surface of the non-orbiting scroll vane and/or the end surface of the connecting portion extends beyond the bearing surface.

In the scroll compressor according to the present application, the flange and the connecting portion of the main bearing housing extend toward each other, so that the distance h can be reduced, that is, a distance D of arm of force from the axial position of the equivalent acting point to a fracture position P can be reduced, and therefore bolt fracture can be significantly alleviated or prevented.

In some examples, $0<h2/H1<0.3$; $0<h2/H2<0.3$; $0<h/H1<0.6$; or $0<h/H2<0.6$.

In some examples, the axial compliance mounting mechanism includes a bolt and a sleeve located outside the bolt. Or, the axial compliance mounting mechanism includes a shouldered bolt.

In some examples, the scroll compressor is such configured that the axial position of the equivalent acting point is offset toward the main bearing housing relative to the axial geometric center position between the first surface and the second surface during normal operation.

In some examples, an outer contour of the axial compliance mounting mechanism or an inner contour of the mounting hole of the flange has a convex section, such that the axial position of the equivalent acting point is offset toward the main bearing housing relative to the axial geometric center position.

In some examples, the convex section is in the form of a curved surface or a shoulder forming a step.

From the following detailed description, other application fields of the present application will become more apparent. It should be understood that, although these detailed descriptions and specific examples show preferred embodiments of the present application, these detailed descriptions and specific examples are for the purpose of illustration, rather than to limit the present application.

BRIEF DESCRIPTION OF THE DRAWINGS

The features and advantages of one or more embodiments of the present application will become more readily understood from the following description with reference to the accompanying drawings in which.

DETAILED DESCRIPTION OF THE EMBODIMENTS

Figure 1:
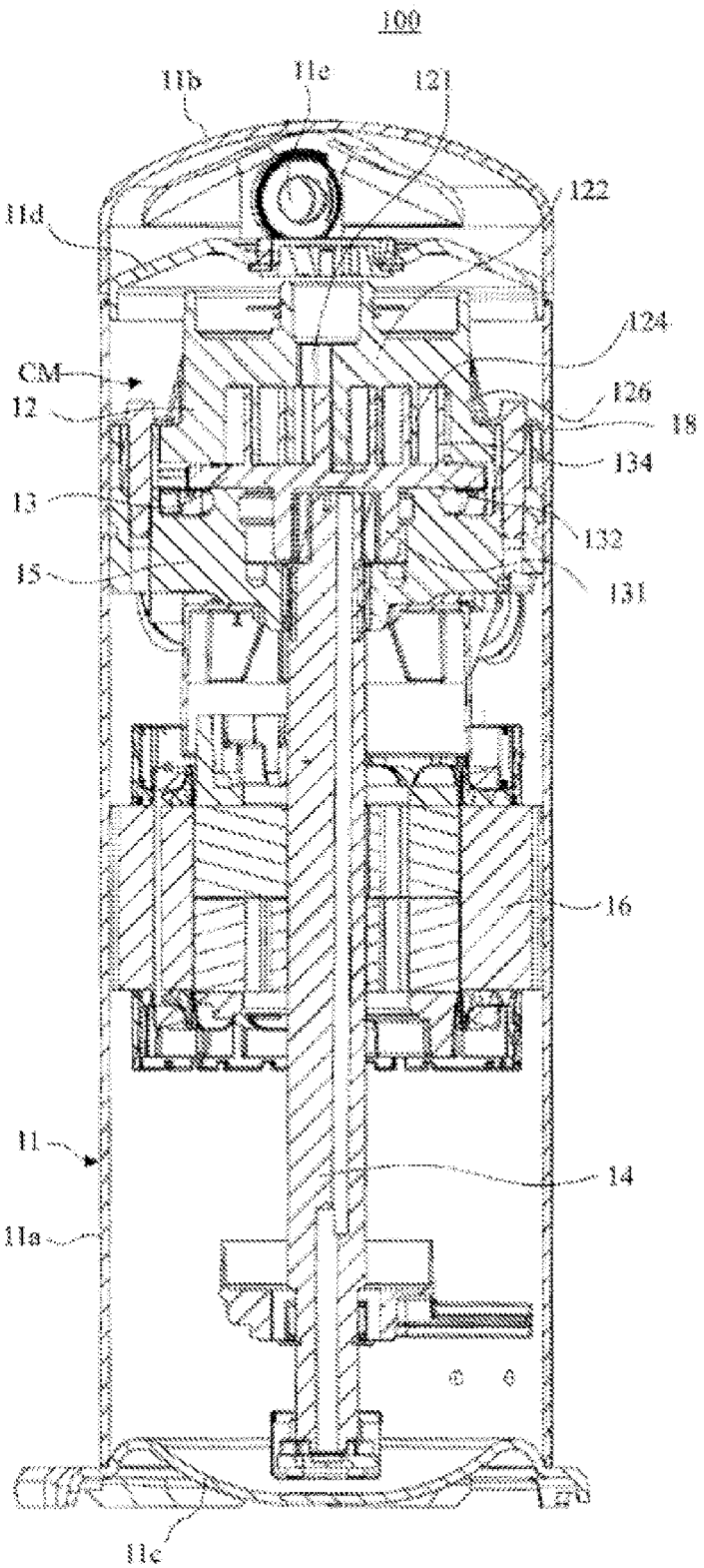
FIG. 1 is a schematic perspective view of a scroll compressor according to an embodiment of the present application.

Exemplary embodiments will now be described more comprehensively with reference to the accompanying drawings.

Exemplary embodiments are provided so that the present application will be thorough and will more fully convey the scope to those skilled in the art. Many specific details such as examples of specific components, devices, and methods are described to provide a thorough understanding of various embodiments of the present application. It will be clear to those skilled in the art that the exemplary embodiments may be implemented in many different forms without using specific details, none of which should be construed as limiting the scope of the present application. In some exemplary embodiments, well-known processes, well-known device structures, and well-known technologies are not described in detail.

The overall structure of a scroll compressor 100 will be described below with reference to FIG. 1. As shown, the compressor 100 includes a housing 11, a compression mechanism CM, a motor 16, a rotating shaft (also referred to as a drive shaft or a crankshaft) 14, and a main bearing housing 15.

The housing 11 may include a cylindrical body 11*a*, a top cover 11*b* located at the top end of the cylindrical body 11*a*, and a bottom cover 11*c* located at the bottom end of the cylindrical body 11*a*. The housing 11 forms a closed space in which the compression mechanism CM, the motor 16, the rotating shaft 14 and the main bearing housing 15 are accommodated. A partition plate 11*d* may further be provided between the top cover 11*b* and the cylindrical body 11*a*. The partition plate 11*d* divides the closed space of the housing 11 into a high-pressure side and a low-pressure side. The high-pressure side is defined by the partition plate 11*d* and the top cover 11*b*, and the low-pressure side is defined by the partition plate 11*d*, the cylindrical body 11*a*, and the bottom cover 11*c*.

The cylindrical body 11*a* is provided with an inlet port (not shown) for introducing the working fluid with a suction pressure into the housing 11. The top cover 11*b* is provided with an outlet port 11*e* for discharging the working fluid with discharge pressure compressed by the compression mechanism CM out of the housing 11. During the operation of the scroll compressor 100, the low-pressure working fluid is introduced into the compressor 100 via the inlet port (introduced to the low-pressure side in the example shown in FIG. 1), sucked into the compression mechanism CM, discharged to the high-pressure side after being compressed, and finally discharged out of the scroll compressor 100 via the outlet port 11*e*.

The compression mechanism CM includes a non-orbiting scroll 12 fixed to the housing 11 (specifically, the cylindrical body 11*a*) and an orbiting scroll 13. The motor 16 is configured to drive the rotating shaft 14 to rotate, which in turn drives the orbiting scroll 13 to orbit relative to the non-orbiting scroll 12 (i.e., a center axis of the orbiting scroll moves around a central axis of the non-orbiting scroll, but the orbiting scroll does not rotate around its own center axis) to compress the working fluid. The orbiting movement is realized via an Oldham coupling 17 (referring to FIG. 2).

Figure 2:
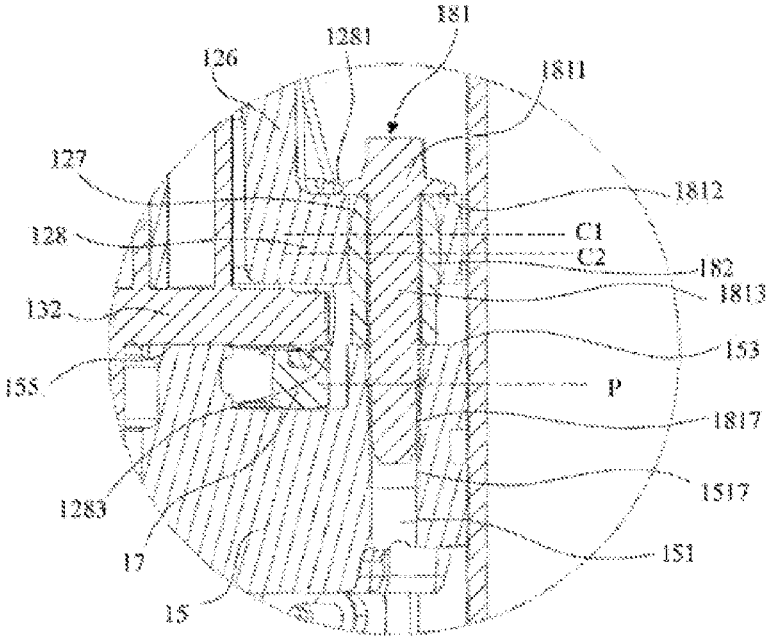
FIG. 2 is a schematic partial cross-sectional view of the scroll compressor shown in FIG. 1.

The non-orbiting scroll 12 may be fixed relative to the housing 11 in any suitable manner. As shown, the non-orbiting scroll 12 is fixedly mounted to the main bearing housing 15 by bolts, which will be described in detail later. The non-orbiting scroll 12 may include a non-orbiting scroll end plate 122, a non-orbiting scroll vane 124 extending from one side of the non-orbiting scroll end plate 122, and an outlet 121 located approximately at a central portion of the non-orbiting scroll end plate 122. For ease of description, the radially outermost portion of the non-orbiting scroll vane 124 is referred to as a peripheral wall portion 126 herein. As shown in FIG. 2, the non-orbiting scroll 12 further has a flange 128 extending radially outward from an outer peripheral surface of the peripheral wall portion 126. The flange 128 is provided therein with a mounting hole 127 for receiving an axial compliance mounting mechanism, so as to be connected to the main bearing housing 15.

The orbiting scroll 13 may include an orbiting scroll end plate 132, an orbiting scroll vane 134 formed on one side of the orbiting scroll end plate 132, and a hub 131 formed on the other side of the orbiting scroll end plate 132. The non-orbiting scroll vane 124 and the orbiting scroll vane 134 can be engaged with each other, so that a series of moving compression chambers with volume gradually decreasing from a radial outer side to a radial inner side are formed between the non-orbiting scroll vane 124 and the orbiting scroll vane 134 during operation of the scroll compressor, so as to compress the working fluid. The hub 131 is engaged with an eccentric crank pin of the rotating shaft 14 and is driven by the eccentric crank pin.

The main bearing housing 15 is adapted to support the orbiting scroll end plate 132 of the orbiting scroll 13. The orbiting scroll end plate 132 orbits on a bearing surface 155 of the main bearing housing 15 (referring to FIG. 2). The main bearing housing 15 may be fixed with respect to the housing 11 of the scroll compressor 100 by any suitable means.

In order to achieve fluid compression, an effective sealing is required between the non-orbiting scroll 12 and the orbiting scroll component 13.

On the one hand, during the normal operation of the scroll compressor, a radial sealing is also required between a side surface of the spiral vane 124 of the non-orbiting scroll 12 and a side surface of the spiral vane 134 of the orbiting scroll 13. The radial sealing between the two is generally achieved by a centrifugal force of the orbiting scroll 13 during orbiting movement and a driving force provided by the rotating shaft 14. In a case that incompressible foreign matter (e.g., solid impurities and liquid refrigerant) enters the compression chamber and gets stuck between the spiral vanes 124 and 134, the spiral vanes 124 and 134 can be temporarily separated from each other in the radial direction to allow the foreign matter to pass through, thereby preventing the spiral vanes 124 and 134 from being damaged, so as to provide the scroll compressor 100 with radial compliance.

On the other hand, during the normal operation of the scroll compressor, an axial sealing is further required between a tip of the spiral vane 124 of the non-orbiting scroll 12 and the end plate 132 of the orbiting scroll 13, and between a tip of the spiral vane 134 of the orbiting scroll 13 and the end plate 122 of the non-orbiting scroll 12. In a case of excessive pressure in the compression chamber of the scroll compressor, the fluid in the compression chamber leaks to the low-pressure side through a gap between the tip of the spiral vane 124 of the non-orbiting scroll 12 and the end plate 132 of the orbiting scroll 13 and a gap between the tip of the spiral vane 134 of the orbiting scroll 13 and the end plate 122 of the non-orbiting scroll 12 to achieve unloading, thereby providing the scroll compressor 100 with axial compliance.

In order to provide axial compliance, the non-orbiting scroll 12 is mounted to the main bearing housing 15 via the axial compliance mounting mechanism 18. Referring to FIG. 2, the axial compliance mounting mechanism 18 includes a bolt 181 and a sleeve 182 located radially outside the bolt 181. The bolt 181 has a stem portion 1813, a head portion 1811 located at one end of the stem portion 1813, and a threaded portion 1817 located at the other end of the stem portion 1813. The head portion 1811 has an abutting surface 1812 for abutting against an upper end surface 1821 (referring to FIG. 3) of the sleeve 182 and an upper surface (first surface) 1281 of the flange 128. The threaded portion 1817 is configured to be able to be screwed into a threaded hole 151 of the main bearing housing 15. The sleeve 182 is further received in a mounting hole 127 of the flange 128 of the non-orbiting scroll 12 and is located between the head portion 1811 and the upper surface 153 of the main bearing housing 15, thereby positioning the head portion 1811 such that the non-orbiting scroll 12 is capable of moving a predetermined distance in the axial direction.

Figure 13:
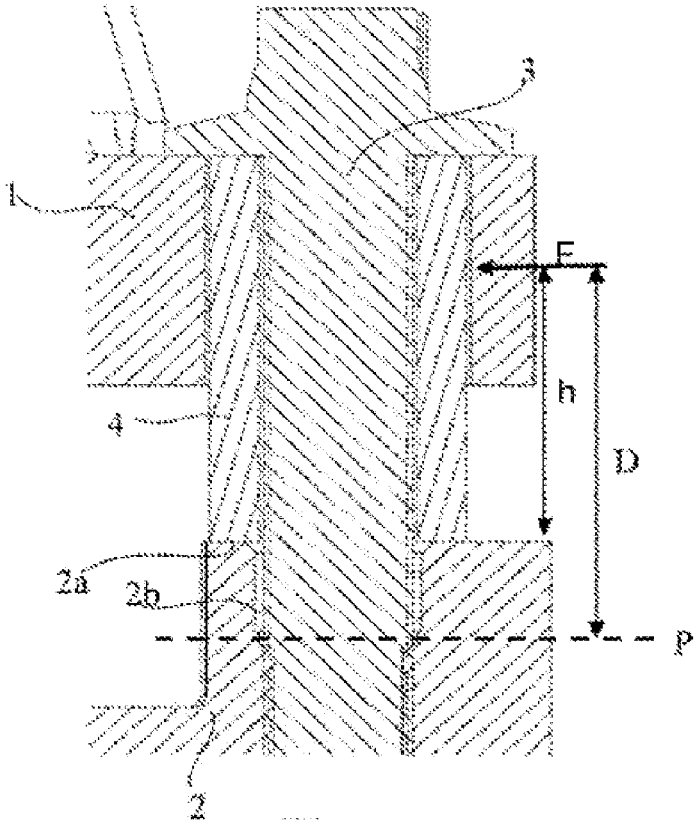
FIG. 13 is a schematic view showing a location of bolt failure.

The inventor found that the bolts of the existing axial compliance mounting mechanism are liable to be loose or fractured. The reason why the bolts are liable to be loose or fractured is analyzed below with reference to FIG. 13. Forces borne by the bolts are very complicated, and thus are simplified for ease of understanding the cause of the fracture. The bolt is liable to be broken or failed at the position P indicated by the dashed line, at an upper threaded joint between the bolt 3 and the main bearing housing 2. With respect to the distance from the flange 128, the "upper threaded joint" is referred to herein as a proximal joint. As described above, when the orbiting scroll (not shown in FIG. 13) orbits relative to the non-orbiting scroll 1, a vane side contact force (acting force) is generated due to the centripetal acceleration, and is transmitted to the bolt 3 via the sleeve 4. It is generally considered that an equivalent acting point of the force F applied to the bolt 3 by the non-orbiting scroll 1 corresponds to an axial geometric center point of the flange of the non-orbiting scroll 1. A distance between the position P and the force F is D, so that a moment M (product of the force F and the distance D) is generated with the position P as the fulcrum. The moment M causes the bolt to be easily broken at the position P. The present application aims to alleviate or prevent the bolt from being broken by reducing the distance D. For the ease of description herein, it is assumed that a distance between the position P and an upper surface 2*a* of the main bearing housing 2 (i.e., an axial height of a counterbore 2*b*) is unchanged in various embodiments. In this way, by reducing the distance h from the upper surface 2*a* of the main bearing housing 2 to the equivalent acting point of the force F, it is possible to alleviate or prevent fracture of the bolt.

When the compressor is operating normally, the orbiting scroll exerts force on the sleeve through the flange (lug) of the non-orbiting scroll. Generally, the flange of the non-orbiting scroll is fitted in the sleeve with face-to-face contact, so the force applied to the sleeve can be regarded as forces distributed over a certain contact area. When the effect of these distributed forces is equivalent to a concentrated force (the force F described herein), the position of the concentrated force F is the axial position of the equivalent point of the force F described herein.

In order to reduce the distance h, the flange 182 of the non-orbiting scroll is located at a lower half of the peripheral wall portion 126 close to the main bearing housing 15. Preferably, the flange extends radially outward from an end of the peripheral wall portion 126 (the lower surface 1283 of the flange 182 is substantially flush with the top surface of the vane 124).

Figure 3:
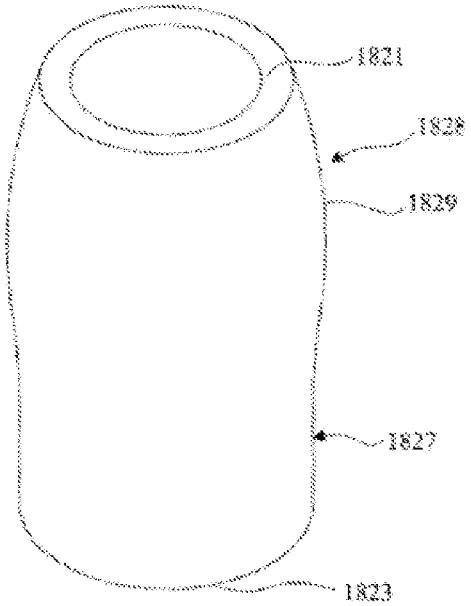
FIG. 3 is a schematic partial enlarged view of the scroll compressor shown in FIG. 2.

FIGS. 1 to 3 show an example of reducing the distance h by modifying an outer contour of a sleeve 182. As shown, the outer contour (outer peripheral surface) of the sleeve 182 is not of a cylindrical shape with a constant diameter, but has a convex section 1828. A dashed line C1 in FIG. 2 represents the axial geometric center position of the flange 128, and a dashed line C2 corresponds to a maximum diameter portion 1829 of the convex section 1828 and therefore represents a position (i.e., the axial position of the equivalent acting point of the force F) where the sleeve contacts with the mounting hole 127 of the flange 182. The convex section 1828 tapers from the maximum diameter portion 1829 toward the upper surface (first surface) 1281 and the lower surface (second surface) 1283 of the flange 128. In examples shown, the sleeve 182 may further have a straight section 1827 with a constant diameter located adjacent to the main bearing housing 15. In FIG. 2, a distance from the position P to the axial position C2 of the equivalent acting point is obviously shorter than a distance from the position P to the axial geometric center position C1.

It will be appreciated that the present application is not limited to the specific embodiments illustrated. For example, the convex section 1828 may only taper from the maximum diameter portion 1829 toward the first surface 1281 of the flange 128, and there is a constant diameter from the maximum diameter portion 1829 to an end adjacent to the main bearing housing 15. In this case, the axial position of the equivalent acting point can be further offset downward, that is, the distance from the position P to the equivalent acting point of force can be further reduced. In the examples shown, the convex section 1828 is in the form of a curved surface. However, it should be understood that the convex section 1828 may also be in the form of a shoulder forming a step or the like. In the shown examples, the sleeve 182 and the bolt 181 are separate components. However, it should be understood that the sleeve 182 and the bolt 181 may be integrated as one piece, that is, a shouldered bolt.

It can be seen from the above content that it is possible to alleviate or prevent fracture of the bolt 181 by providing the outer contour of the axial compliance mounting mechanism 18 with a convex section, which causes the axial position C2 of the equivalent acting point to be lower than the axial geometric center position C1.

Figure 4:
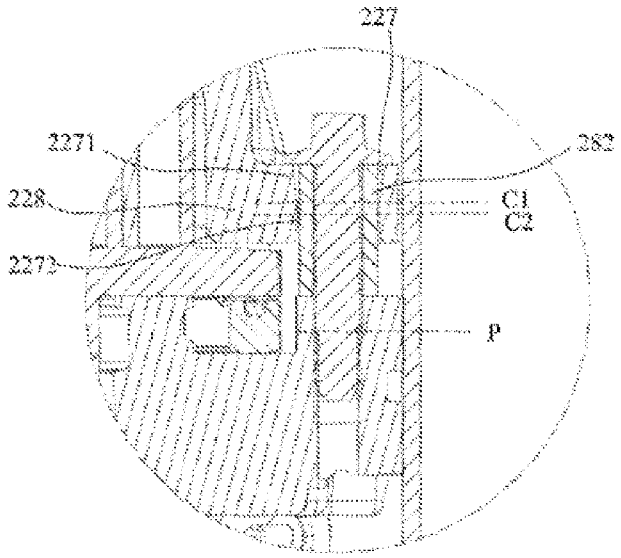
FIG. 4 is a schematic partial cross-sectional view of a scroll compressor according to another embodiment of the present application.
Figure 5:
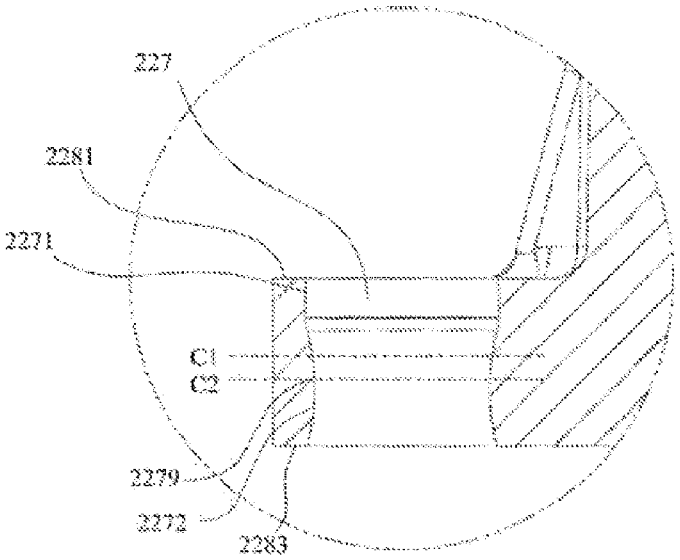
FIG. 5 is a schematic partial enlarged view of a non-orbiting scroll of the scroll compressor shown in FIG. 4.

FIGS. 4 and 5 show an example of reducing the distance h by modifying an inner contour (shape of an inner wall) of a mounting hole 227 of a flange 228. As shown, the inner contour (shape of the inner wall) of the mounting hole 227 is not of a cylindrical shape with a constant diameter, but has a convex section 2272. Therefore, a sleeve 282 may have a cylindrical shape with a constant diameter. Similar to the examples shown in FIGS. 1 to 3, a dashed line C2 corresponds to a maximum diameter portion 2279 of the convex section 2272 and therefore represents a position (i.e., the axial position of the equivalent acting point of the force F) where the mounting hole contacts with the sleeve 282. The convex section 2272 tapers from the maximum diameter portion 2279 toward the upper surface (first surface) 2281 and the lower surface (second surface) 2283 of the flange 228. In examples shown, the mounting hole 227 may further have a straight section 2271 with a constant diameter located adjacent to the upper surface (first surface) 2281. In FIG. 4, a distance from the position P to the axial position C2 of the equivalent acting point is obviously shorter than a distance from the position P to the axial geometric center position C1.

It will be appreciated that the present application is not limited to the specific embodiments illustrated. For example, the convex section 2272 may have any other suitable form, as long as the axial position C2 of the equivalent acting point is below the axial geometric center position C1.

Figure 6:
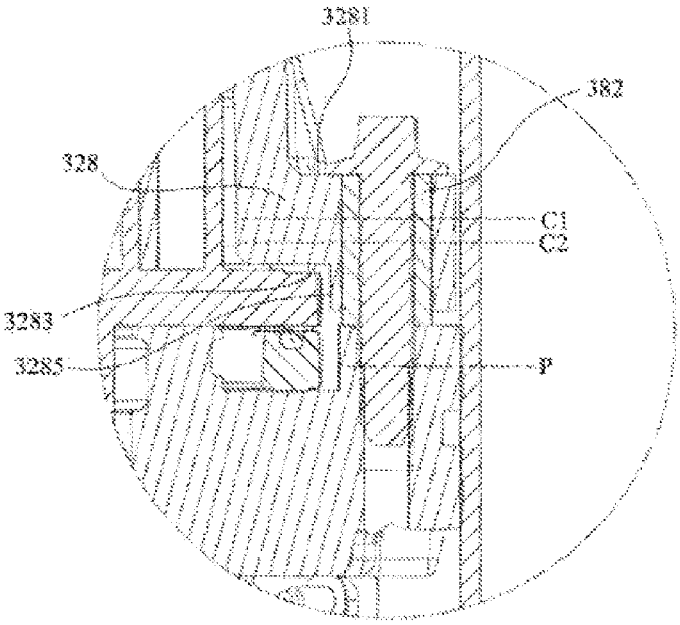
FIG. 6 is a schematic partial cross-sectional view of a scroll compressor according to yet another embodiment of the present application.
Figure 7:
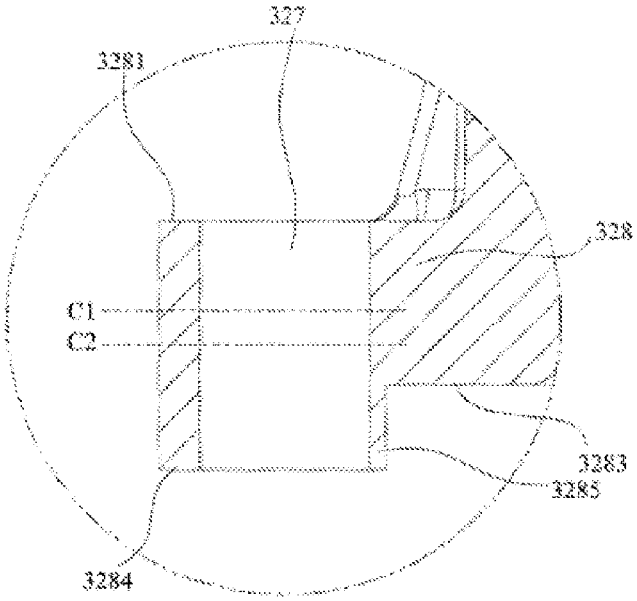
FIG. 7 is a schematic partial enlarged view of the non-orbiting scroll of the scroll compressor shown in FIG. 6.

FIGS. 6 and 7 show another example of reducing the distance h by modifying the structure of a flange 328. As shown, the flange 328 further has an extension portion 3285 extending downward in the axial direction from a lower surface (second surface) 3283, so that a lower end surface (third surface) 3284 of the extension portion 3285 is below a top surface of the non-orbiting scroll vane 124. In this example, a mounting hole 327 of the flange 328 may have a constant inner diameter, and a sleeve 382 may also have a constant outer diameter substantially equal to the inner diameter of the mounting hole 327.

In the example shown in FIGS. 6 and 7, the dashed line C1 still represents an axial geometric center position between an upper surface (first surface) 3281 and the lower surface (second surface) 3283, and the dashed line C2 corresponds to an axial geometric center position between the upper surface (first surface) 3281 and the lower end surface (third surface) 3284 and therefore represents an axial position of the equivalent acting point of the force F applied to the bolt. In this example, by extending the length of the mounting hole 327 toward the main bearing housing 15, the axial position of the equivalent acting point is offset toward the main bearing housing 15, thereby reducing a distance from the position P to the axial position of the equivalent acting point, i.e., reducing the distance h.

Figure 8:
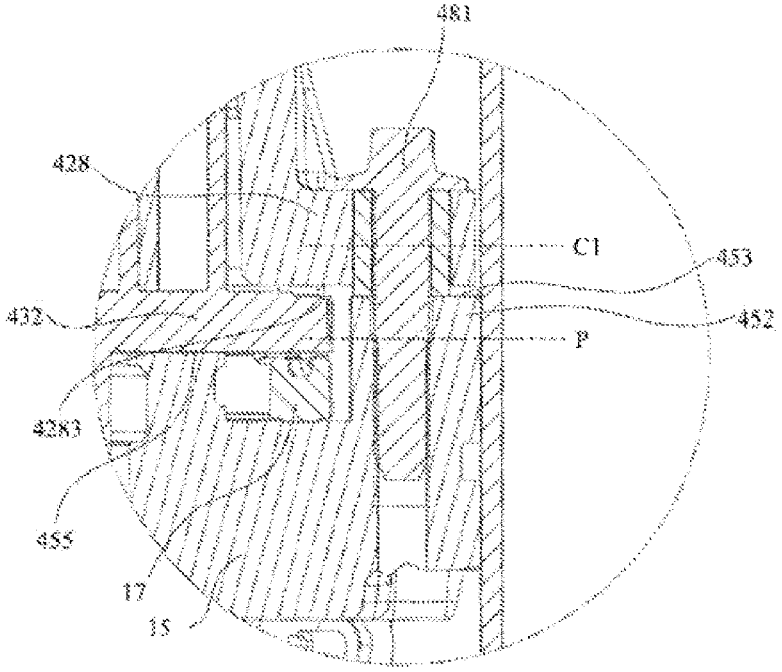
FIG. 8 is a schematic partial cross-sectional view of a scroll compressor according to another embodiment of the present application.
Figure 9:
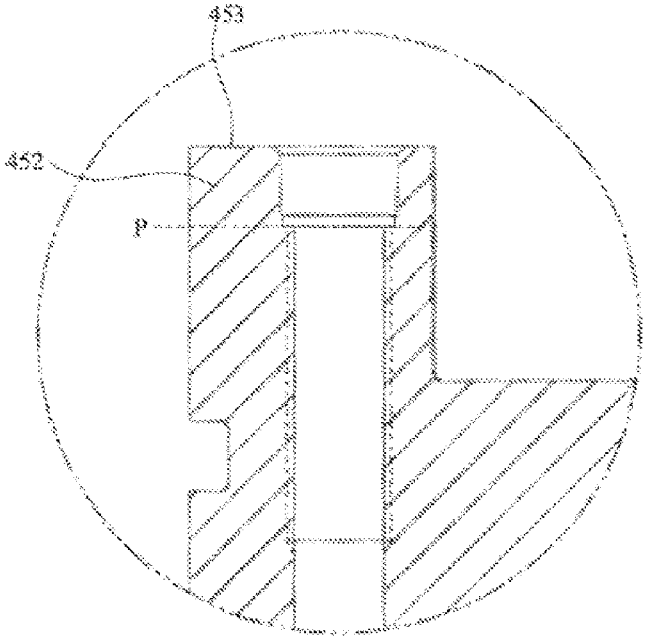
FIG. 9 is a schematic partial enlarged view of a main bearing housing of the scroll compressor shown in FIG. 8.

FIGS. 8 and 9 show another example of reducing the distance h by modifying the structure of the main bearing housing 15. As shown, the main bearing housing 15 has a connecting portion 452 for threaded engagement with a bolt 481. The connecting portion 452 may extend toward the flange such that an upper end surface 453 of the connecting portion 452 is higher than a bearing surface 455 for supporting an end plate 432 of the orbiting scroll 13, and more preferably, the connecting portion 452 is close to a lower surface 4283 of a flange 428. As described above, for the ease of description herein, it is assumed that a distance between the position P and an upper surface of the main bearing housing (i.e., an axial height of a counterbore) is unchanged in each embodiment. Therefore, in the examples shown in FIGS. 8 and 9, by extending the connecting portion 452 toward the flange 428, the position P is offset toward the flange 428, thereby reducing the distance h.

Figure 10:
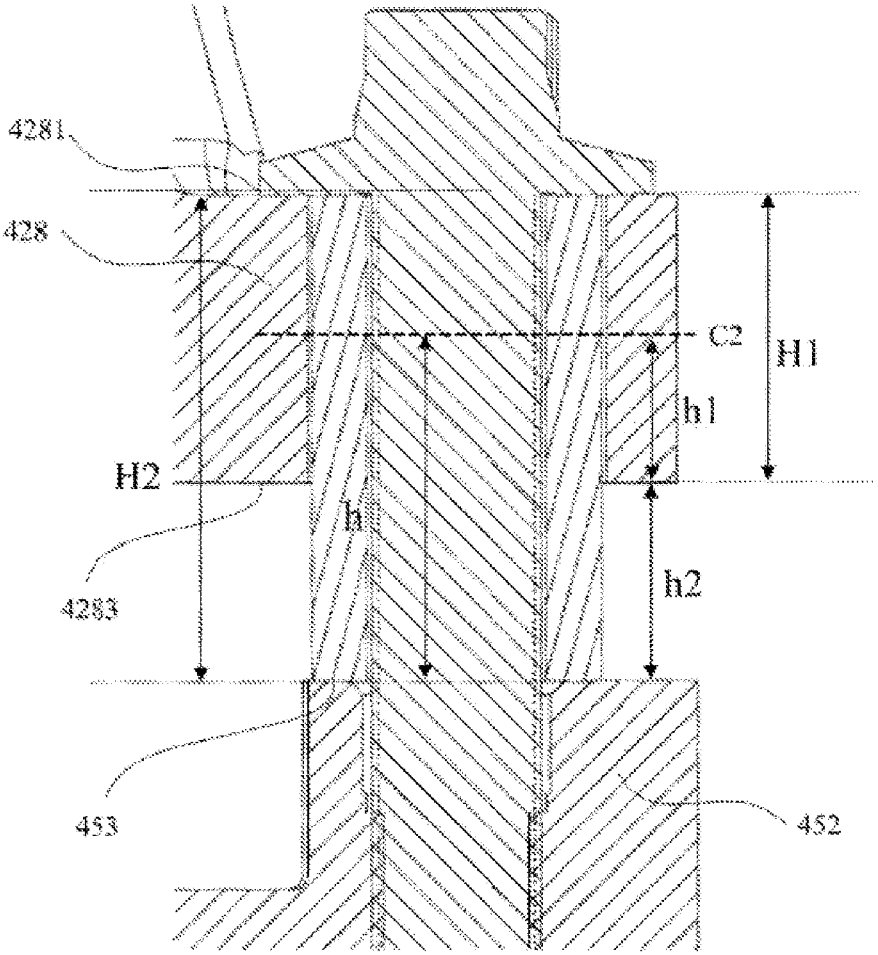
FIG. 10 is a schematic view of parameters associating the axial compliance mounting mechanism with the non-orbiting scroll and the main bearing housing of the scroll compressor.

The inventor has further made a finite element analysis on some parameters related to the axial compliance mounting mechanism 18. By optimizing the design of some parameters, the bolt fracture can also be alleviated or prevented. Reference is made to FIG. 10 below to understand the parameters related to alleviating or preventing bolt fracture. The components in FIG. 10 that are the same as those in FIG. 8 are denoted by the same reference numerals as in FIG. 8.

As shown in FIG. 10, the height of the flange 428 between the first surface 4281 and the second surface 4283 is indicated by H1. A distance between an axial position C2 of the equivalent acting point of the force applied by the flange 428 to the axial compliance mounting mechanism and the second surface 4283 is indicated by h1. A distance between the first surface 4281 and the end surface 453 of the connecting portion 452 is indicated by H2. A distance between the second surface 4283 and the end surface 453 is indicated by h2. A distance between the axial position C2 of the equivalent acting point and the end face 453 is indicated by h, and h=h1+h2.

Through finite element analysis, the inventor found that bolt fracture can be significantly alleviated or prevented in a case that the following conditions are met: $0<h2/H1<0.3$; $0<h2/H2<0.3$; $0<h/H1<0.6$; or $0<h/H2<0.6$.

Figure 11A:
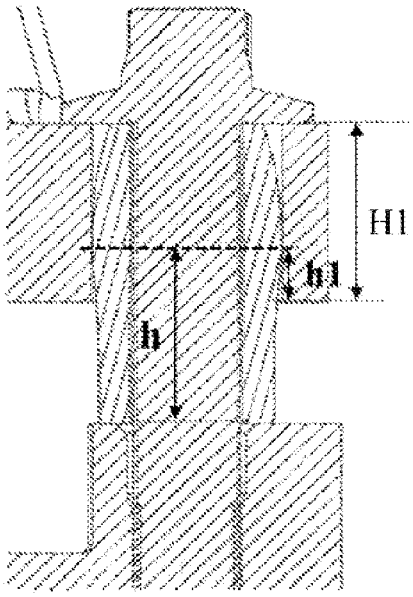
FIGS. 11*a* to 11*d* are schematic views of parameters provided according to various embodiments of the present application.
Figure 11B:
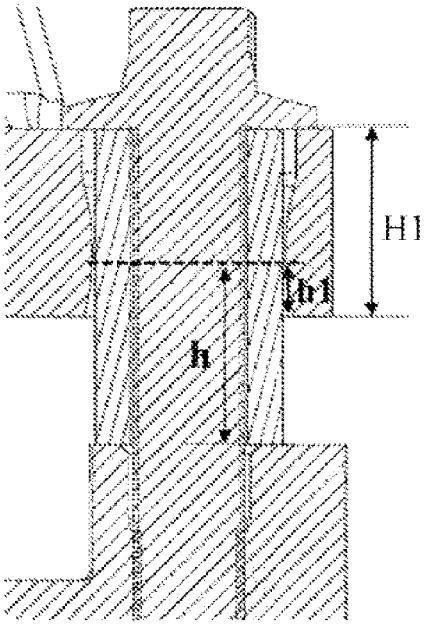

The inventor has further performed tests within these parameter ranges with respect to various embodiments described above. FIG. 11*a* corresponds to the embodiment shown in FIGS. 1 to 3, and FIG. 11*b* corresponds to the embodiment shown in FIGS. 4 and 5. In the examples shown in FIG. 11*a* and FIG. 11*b*, h1/H1=0.25, and h=14.5. The tests show that this parameter can significantly alleviate or prevent bolt fracture.

Figure 11C:
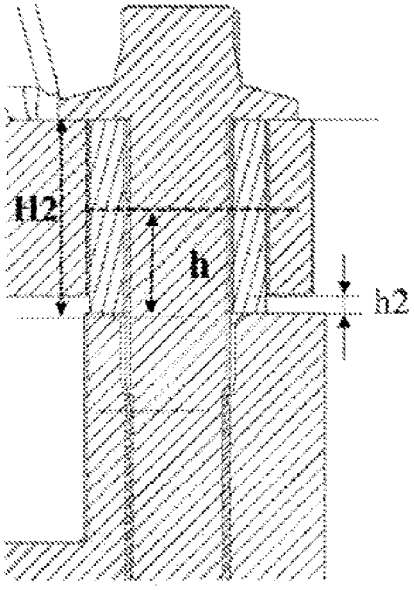
Figure 11D:
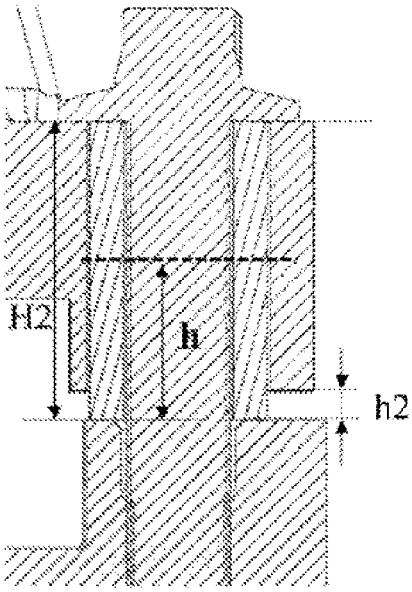

FIG. 11*c* corresponds to the embodiment shown in FIGS. 8 and 9. In the example shown in FIG. 11*c*, h2/H2=0.06, h/H2=0.36, and h=9.3. Tests show that this parameter can significantly alleviate or prevent bolt fracture. FIG. 11*d* corresponds to the embodiment shown in FIGS. 6 and 7. In the example shown in FIG. 11*d*, h2/H2=0.10, h/H2=0.55, and h=14.3. Tests show that this parameter can significantly alleviate or prevent bolt fracture.

The inventor has further tested moments generated at the position P at different distances h under the same force. In these tests, structures of the flange, the main bearing housing and the axial compliance mounting mechanism are the same, and only value of the distance h is varied. The test results are shown in Table 1 below.

TABLE 1

| Force F (N) | Distance h (mm) | Moment at position P (N * mm) |
|---|---|---|
| 3000 | 8.2 | 2803 |
| 3000 | 10.2 | 3229 |
| 3000 | 12.2 | 3665 |
| 3000 | 14.2 | 4105 |
| 3000 | 16.2 | 4546 |
| 3000 | 18.2 | 4975 |
| 3000 | 20.2 | 5418 |
| 3000 | 22.2 | 5851 |
| 3000 | 24.2 | 6289 |

Figure 12:
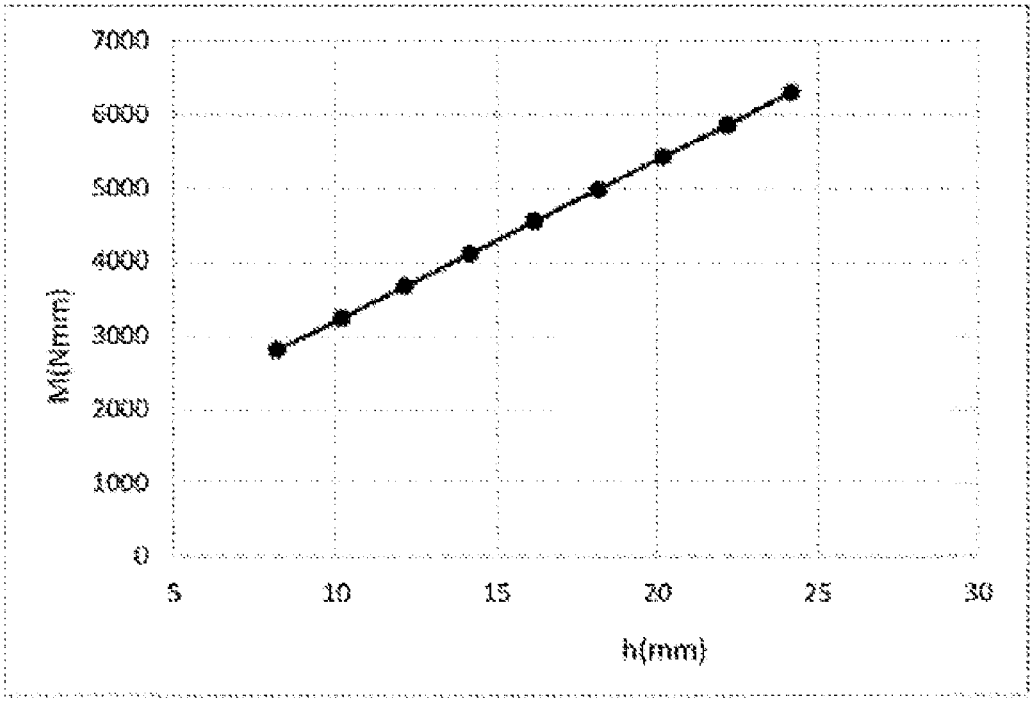
FIG. 12 is a graph showing the effect of the scroll compressor according to the present application.

A graph is drawn according to Table 1, referring to FIG. 12. FIG. 12 more intuitively shows that the smaller the distance h is, the smaller the moment at the position P is. Therefore, by reducing the distance h, bolt fracture can be significantly alleviated or prevented.

While the present application has been described with reference to the exemplary embodiments, it will be appreciated that the present application is not limited to the specific embodiments described and illustrated in detail herein. The person skilled in the art can make various variants to the exemplary embodiments without departing from the scope defined by the claims. It should further be understood that, provided that there is no contradiction in technical solutions, the features in the various embodiments can be combined with each other, or can be omitted.

The invention claimed is:

1. A scroll compressor, comprising:

a non-orbiting scroll having a non-orbiting scroll end plate and a non-orbiting scroll vane extending from one side of the non-orbiting scroll end plate;

an orbiting scroll having an orbiting scroll end plate and an orbiting scroll vane extending from one side of the orbiting scroll end plate, wherein the orbiting scroll is configured to orbit relative to the non-orbiting scroll, so that a series of compression chambers for compressing working fluid are formed between the non-orbiting scroll vane and the orbiting scroll vane;

a main bearing housing fixedly mounted to a housing of the scroll compressor and having a bearing surface for slidably supporting the orbiting scroll end plate; and an axial compliance mounting mechanism configured to fixedly connect the non-orbiting scroll to a connecting portion of the main bearing housing, such that the non-orbiting scroll is movable by a predetermined distance in an axial direction, wherein the non-orbiting scroll further has a flange extending radially outward from a peripheral wall portion of the non-orbiting scroll, the flange has a first surface facing the non-orbiting scroll end plate, a second surface facing the orbiting scroll end plate, and a mounting hole extending from the first surface to the second surface for receiving the axial compliance mounting mechanism, the flange has an axial geometric center position located between the first surface and the second surface, and the flange is positioned such that the axial geometric center position is closer to the orbiting scroll end plate than an axial middle position of the peripheral wall portion, a height of the flange between the first surface and the second surface is H1, a distance between an axial position of an equivalent acting point of force borne by the axial compliance mounting mechanism and the second surface is h1, a distance between the first surface and an end surface of the connecting portion is H2, a distance between the second surface and the end surface is h2, a distance between the axial position of the equivalent acting point and the end surface is h, and h=h1+h2, the scroll compressor is configured such that the axial position of the equivalent acting point is offset toward the main bearing housing relative to the axial geometric center position during normal operation.

2. The scroll compressor according to claim 1, wherein an outer contour of the axial compliance mounting mechanism and/or an inner contour of the mounting hole of the flange has a convex section, so that the axial position of the equivalent acting point is offset toward the main bearing housing relative to the axial geometric center position.

3. The scroll compressor according to claim 2, wherein the convex section is in a form of a curved surface or a shoulder forming a step.

4. The scroll compressor according to claim 1, wherein the flange comprises an extension portion extending from the second surface in the axial direction toward the main bearing housing and beyond a top surface of the non-orbiting scroll vane.

5. The scroll compressor according to claim 1, wherein the connecting portion of the main bearing housing that engages with the axial compliance mounting mechanism extends in the axial direction toward the flange and beyond the bearing surface.

6. The scroll compressor according to claim 1, wherein the axial compliance mounting mechanism comprises a bolt and a sleeve located outside the bolt; or, the axial compliance mounting mechanism comprises a shouldered bolt.

7. The scroll compressor according to claim 1, wherein $0<h2/H1<0.3$.

8. The scroll compressor according to claim 1, wherein $0<h2/H2<0.3$.

9. The scroll compressor according to claim 1, wherein $0<h/H1<0.6$.

10. The scroll compressor according to claim 1, wherein $0<h/H2<0.6$.

11. A scroll compressor comprising:

a non-orbiting scroll comprising a non-orbiting scroll end plate and a non-orbiting scroll vane extending from one side of the non-orbiting scroll end plate;

an orbiting scroll comprising an orbiting scroll end plate and an orbiting scroll vane extending from one side of the orbiting scroll end plate, wherein the orbiting scroll is configured to orbit relative to the non-orbiting scroll, so that a series of compression chambers for compressing working fluid are formed between the non-orbiting scroll vane and the orbiting scroll vane;

a main bearing housing having a bearing surface for slidably supporting the orbiting scroll end plate; and an axial compliance mounting mechanism configured to fixedly connect the non-orbiting scroll to a connecting portion of the main bearing housing, such that the non-orbiting scroll is movable by a predetermined distance in an axial direction, wherein the non-orbiting scroll further has a flange extending radially outward from a peripheral wall portion of the non-orbiting scroll, the flange has a first surface facing the non-orbiting scroll end plate, a second surface facing the orbiting scroll end plate, and a mounting hole extending from the first surface to the second surface for receiving the axial compliance mounting mechanism, a height of the flange between the first surface and the second surface is H1, a distance between an axial position of an equivalent acting point of force borne by the axial compliance mounting mechanism and the second surface is h1, a distance between the first surface and an end surface of the connecting portion is H2, a distance between the second surface and the end surface is h2, a distance between the axial position of the equivalent acting point and the end surface is h, and h=h1+h2, the flange and/or the connecting portion extend toward each other in the axial direction, such that the second surface of the flange extends beyond a top surface of the non-orbiting scroll vane, and/or the end surface of the connecting portion extends beyond the bearing surface.

12. The scroll compressor according to claim 11, wherein $0<h2/H1<0.3$.

13. The scroll compressor according to claim 11, wherein $0<h2/H2<0.3$.

14. The scroll compressor according to claim 11, wherein $0<h/H1<0.6$.

15. The scroll compressor according to claim 11, wherein $0<h/H2<0.6$.

16. The scroll compressor according to claim 11, wherein the axial compliance mounting mechanism comprises a bolt and a sleeve located outside the bolt; or, the axial compliance mounting mechanism comprises a shouldered bolt.

17. The scroll compressor according to claim 11, wherein the scroll compressor is configured such that the axial position of the equivalent acting point is offset toward the main bearing housing relative to an axial geometric center position between the first surface and the second surface during normal operation.

18. The scroll compressor according to claim 17, wherein an outer contour of the axial compliance mounting mechanism or an inner contour of the mounting hole of the flange has a convex section, such that the axial position of the equivalent acting point is offset toward the main bearing housing relative to the axial geometric center position.

19. The scroll compressor according to claim 18, wherein the convex section is in a form of a curved surface or a shoulder forming a step.

* * * * *